US005969280A

United States Patent [19]

Marcinkiewicz

[11] Patent Number: 5,969,280

[45] Date of Patent: Oct. 19, 1999

[54] BRASS-WIND MUSICAL INSTRUMENT MOUTHPIECE

[76] Inventor: Joseph W. Marcinkiewicz, P.O. Box 544, Beavercreek, Oreg. 97004

[21] Appl. No.: 08/882,086

[22] Filed: Jun. 25, 1997

[51] Int. Cl.[6] ..... G10D 9/02

[52] U.S. Cl. ..... 84/398

[58] Field of Search ..... 84/398, 383 R

[56] References Cited

U.S. PATENT DOCUMENTS

| | | | |
|---|---|---|---|
| 828,979 | 8/1906 | Seefeldt | 84/398 |
| 1,178,513 | 4/1916 | George | 84/398 |
| 2,104,388 | 1/1938 | Lunow | 84/398 |
| 2,542,720 | 2/1951 | Saklaski | 446/209 |
| 3,370,500 | 2/1968 | Zwolak | 84/398 |
| 4,395,933 | 8/1983 | Shepley | 84/399 |
| 5,218,150 | 6/1993 | Pastor | 84/398 |

OTHER PUBLICATIONS

New York Brass Conference for Scholarships, 25th Annual 1997 Brass Conference program; cover, table of contents, p. 21.

The Brasswind Catalog, Fall/Winter 96–97, pp. 49–56.

Marcinkiewicz Co., Mouthpiece Product Guide, 1997, cover, p. 12.

The Brasswind Catalog, Spring 1997, pp. 50–58 and cover.

*Primary Examiner*—William M. Shoop, Jr.
*Assistant Examiner*—Shih-yung Hsieh
*Attorney, Agent, or Firm*—Eugene H. Valet

[57] ABSTRACT

A brass-wind musical instrument mouthpiece. A plurality of nodal enhancers is provided externally about the portion of the mouthpiece between its rim and shank. In an exemplary embodiment for a trumpet, a total of six rings and seven interspersed grooves in the outer wall of the cup barrel region of the mouthpiece are integrally provided. Better intonation is also achieved with the present invention.

19 Claims, 3 Drawing Sheets

BRASS-WIND MUSICAL INSTRUMENT MOUTHPIECE

BACKGROUND OF THE INVENTION

1. Field of the Invention

The present invention relates generally to musical instruments, more particularly to mouthpieces for brass-wind musical instruments, and, more specifically to a mouthpiece having external features-such as dampers or fins-to enhance produced sounds.

2. Description of Related Art

Brass-wind musical instruments, often referred to as simply brass instruments, are the group of instruments generally characterized by a long cylindrical or conical metal tube commonly curved two or more times and ending in a flared bell. Brass instruments produce tones by passage of air through and vibrations of the player's lips against a usually cup shaped mouthpiece. Brass instruments usually have valves or a slide by which the player may produce all the tones within the instrument's range. Commonly known brass instruments are the trumpet and cornet, the trombone, the French horn, and the tuba; less well known are the fluegelhorn, the euphoniums or baritones, and the marching horns, like the mellophoniums, and the like.

In order to accommodate the nearly infinite variety of embouchures among individual players and the different types of music, a large variety of mouthpieces have been developed for brass-wind instruments. In fact, the brass-wind instrument player is faced with hundreds of choices of mouthpieces in various manufacture and design as demonstrated in The Brasswind Catalog, Fall/Winter 96-07, copr. The Woodwind & The Brasswind Company, South Bend, Ind., pages 48–56.

Different design specifications for the mouthpiece's rim, cup dimensions, throat entrance, venturi, backbore and shank are used to change or adjust the performance of the mouthpiece and hence the sounds made by the brass instrument with which it is used. For example, the shallower the cup, the brighter the sound that will be produced. The average player will select a standardized, medium performance, mouthpiece to play his instrument comfortably and accurately across the entire musical register of the instruments range. Performance quality is thus partially sacrificed for comfort, endurance, and control.

Adjustments and modifications to rim, cup, throat, backbore, and overall mass features of brass-wind mouthpieces have been used in the past in attempts to produce mouthpieces that are both true to pitch across the entire range of a brass-wind instrument's range. However, the change of one feature to affect a different result in one aspect, e.g., endurance, often conversely affects another aspect, e.g., flexibility. Generally, manufacturer's provide an assortment of combinations from which a player can pick and choose that which provides him the best average performance level. Many serious musicians use more than one mouthpiece to optimize performance based on their individual embouchure and on the particular musical piece being performed. For example, for a musical piece having many notes at the high end of the register in an instrument' range, the musician may switch to a mouthpiece having design specifications facilitating high register note production.

In order to obtain what is known as a "dark" (less piercing, less brilliant) sound, some manufacturers have introduced "heavy wall" mouthpieces, having a thick cup barrel section. A common problem with heavy wall mouthpieces is that they limit the number of harmonics resonating from the instrument; higher frequency harmonics are virtually non-existent. However, certain selected ones of such higher harmonics are desirable as they can interface and blend with notes of surrounding instruments of a music ensemble and produce a much richer quality in the overall sound, adding "life" or "color" to the performance of the group.

Another common problem with brass instruments is that mouthpieces tend not to be true to pitch for all notes throughout the chromatic scales within their range. For example, in using a B-flat, Bb, trumpet high range notes, such as the second-C above piano middle-C and higher tend to go flatter than the true octave pitch; some mouthpiece designs exaggerate this effect more than others. Backbore and throat size adjustments are generally used to compensate for this problem.

There have been a variety of attempts to improve the tone or quality or pitch of the notes produced by changing mouthpiece designs. For example, in U.S. Pat. No. 4,395,933 (Shepley) for a Mouthpiece for Brass-Wind Instruments, an assembled mouthpiece having a cup formed of four wall sections 42–48 of differing angularity is said to allow improved player performance.

There is a need for a mouthpiece designed to produce a better and more stable sound made by a brass-wind instrument throughout its musical register range, particularly in heavy wall mouthpiece designs that are intended to produce rich, dark, symphonic sounds.

SUMMARY OF THE INVENTION

In its basic aspects, the present invention provides a brass-wind musical instrument mouthpiece, having a rim, a cup having a throat at its inner extremity, and a shank having a backbore coupled to the throat, and a barrel, between the rim and the shank, encompassing the cup and throat, the barrel having at least one external, circumferential ring and at least one circumferential groove adjacent the ring.

In another basic aspect, the present invention provides a method of enhancing musical tones produced via a brass-wind musical instrument mouthpiece, the mouthpiece having a rim, a cup, and a shank, and a barrel region between the rim lower extremity and the shank upper extremity, the method including the step of varying the wall thickness of the barrel region non-linearly in specific, calculated areas such that nodal enhancement and substantially constant intonation is provided.

In a third basic aspect, the present invention provides a brass-wind musical instrument mouthpiece, including: a rim for interfacing the mouthpiece to a player's lips; a cup beginning at the rim and continuing into the mouthpiece; a barrel, having an outer wall surrounding the cup; a shank, having a backbore there through, wherein the backbore is in open communication with a lowest extremity of the cup via a venturi; and the barrel having a wall of non-linear varying thickness between the rim and the shank.

It is an advantage of the present invention that it provides a brass-wind musical instrument mouthpiece providing improved overall quality of sound production.

It is an advantage of the present invention that it adds desirable frequency harmonics to a tone and dampens undesirable frequency harmonics.

It is an advantage of the present invention that it provides a brass-wind mouthpiece that provides a stable center of pitch.

It is another advantage of the present invention that it improves accuracy of pitch between notes of a musical scale.

It is another advantage of the present invention that it uses a mechanism that does not interfere with changes to other mouthpiece design-expedient features such as the rim, cup, throat, and backbore.

It is still another advantage of the present invention that it can be made integrally with the fabrication of the mouthpiece as a unitary part.

It is another advantage of the present invention that it provides the a rich, dark sound without the additional mass of a conventional heavy wall mouthpiece.

It is a further advantage of the present invention that it provides improved performance in an aesthetically attractive design.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable.

Figure 1:
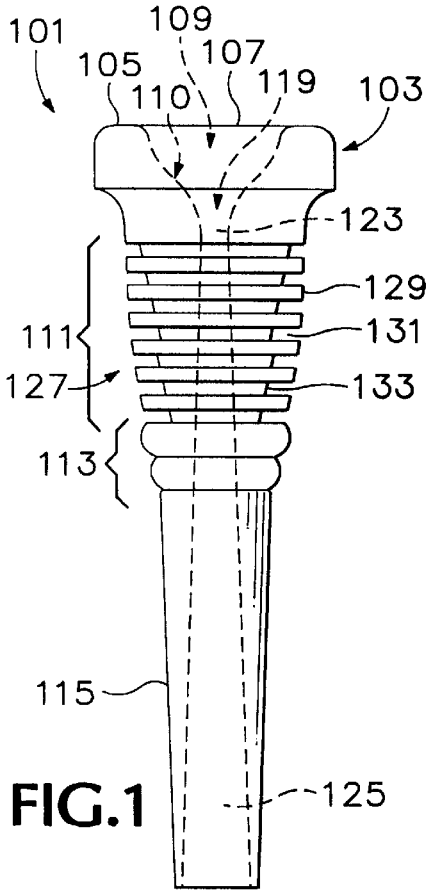
FIG. 1 is a perspective view of a brass-wind musical instrument mouthpiece in accordance with the present invention.

As depicted in FIG. 1, a brass-wind musical instrument mouthpiece 101 has several components which effect the player's ability to produce different tones. In order to describe the present invention, an exemplary embodiment trumpet mouthpiece is depicted. The FIGURES are not intended to create any limitation on the scope of the invention nor should any such intention be implied from the use of this example to describe a preferred embodiment of the invention and certain alternatives. The present invention is applicable to brass-wind instrument mouthpieces in general.

A mouthpiece rim 103, having a facing 105 which interfaces with the player' lips, is generally fabricated with a design selected based upon the lip size and teeth orientation of the individual. Most manufacturer's provide a wide assortment of standard designs from which the musician can pick and choose. The rim 103 size, including outer diameter, $R_{OD}$, width, $R_W$, and contour (round to flat) are selected by what feels comfortable to the player. A wide rim increases endurance, but limits flexibility; a narrow rim facilitates a wide range of pitch. The rim 103 also is designed with an inner edge 107 which needs to fit the player's embouchure without being so sharp that it cuts the flesh, yet not so rounded that there is no bite (where "bite" means the ability to hold the mouthpiece comfortably to the lips without excess pressure and without air leakage around the rim). Generally, the sharper the inner edge rim, the more brilliant the tone and the more reliable the player's attack.

A cup 109, internal of the mouthpiece extends within the rim 103 toward an upper barrel 111 section of the mouthpiece. Cups 109 are sized and shaped to reflect the player's choice for type of sound, ranging from very dark to very bright. As examples, a large cup diameter, $C_D$, produces a large volume and reduces risk of cracked tones, but requires more strength; a deep cup improves tone, darkening the sound, especially in lower register notes for the instrument, but makes higher notes more difficult to produce. A shallower cup produces a brighter sound because it produces a higher compression of the air entering, but lower register attack may be more difficult. Moreover, the cup inner wall 110 contour is also important as it also affects sound quality.

A transition region 113 couples the mouthpiece upper barrel 111 to a shank 115. The shank 115 is tapered and the distal end 117 of the mouthpiece 101 is sized, having an outer diameter appropriate for a releasable sliding fit into a leadpipe (not shown) of the musical instrument to be played. If the mouthpiece 101 does not go into a leadpipe properly, too much resistance is produced, causing an undesirable sound for certain notes.

A thicker and longer barrel 111, referred to in the art as a "heavy wall" mouthpiece, having a larger mass is generally used to produce a dark symphonic sound. The outer wall of the barrel 111 of a heavy wall mouthpiece is generally characterized by a slower bevel between the rim 103 diameter and the transition region 113 or shank 115 diameter.

Figure 2:
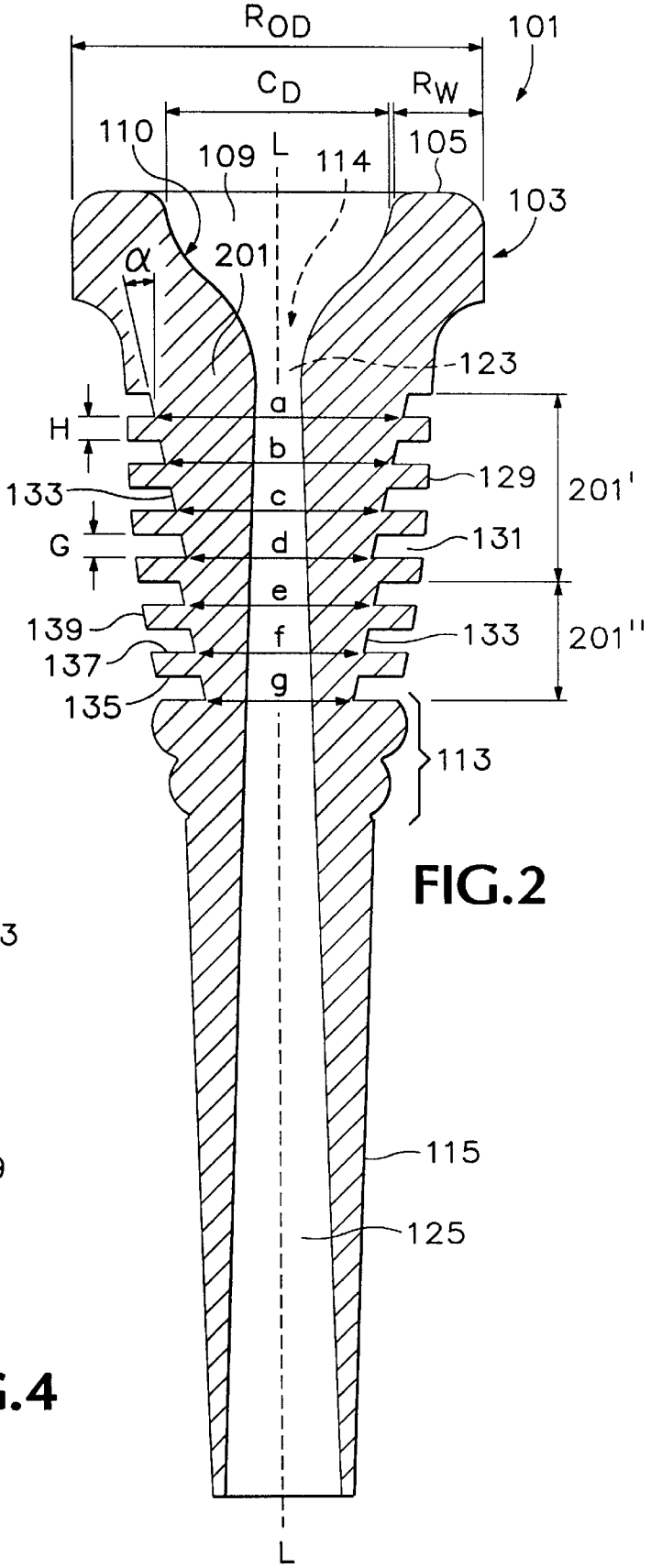
FIG. 2 is a cross-sectional elevation view of the present invention as shown in FIG. 1.

Turning also to FIG. 2, a mouthpiece 101 in accordance with the present invention is shown in a cross-sectional elevation drawing. At the inner reach of the cup 109, a throat entrance 119 determines how smoothly the air moves from the cup through a throat venturi, or drill, 123. If the entrance is too sharp, it creates significant resistance, or back pressure. The size and shape of the venturi 123 determines the amount of air the player can put through the mouthpiece 101 and instrument and again can be tailored to specific performance goals, particularly cutting wind turbulence through the throat. The throat entrance 119 can be tapered to match the player's style and performance goals, although again, manufacturer's have developed a wide range of standard design combinations of rim, cup, and throat from which the musician can pick and choose. The goal is to achieve the correct efficiency for the particular player.

From the venturi 123, air is delivered through a backbore 125 into the instrument's leadpipe. The backbore 125 either spreads the air or channels the air, depending on how tight or open the design in accordance with Bernoulli's principles. The backbore 125 influences the color, nuance, and timbre of the mouthpiece 101 and, hence, the instrument with which it is used. For example, a large backbore with a large cup produce an easier and broader sound; however, a tighter backbore focuses the sound, equalizing the lower register and accenting the upper end of a tone. A proper backbore 125 should enhance the player's ability to move easily throughout all registers in the range of the instrument with uniformity of timbre and feel; an improper backbore 125 can also make certain notes of a scale flat or sharper. Moreover, the backbore 125 dictates projection of the sound produced; a larger backbore spreads the sound and a narrower backbore directs the sound toward the distance (e.g., back of an auditorium).

The mouthpiece of the present invention uses a unique and functional exterior feature in the nature of nodal enhancers 127, also referred to as "vibration dampers" or simply "dampers." The nodal enhancers 127 are in the form of circumferential rings (or bands, or radial fins, or collars, or the like) 129 and grooves 131 in the barrel 111. In the preferred embodiment, a set of seven rings 129 and six grooves 131 are provided, one for each of the thirteen notes in any chromatic scale. In the embodiment shown, grooves have an identical height dimension, "G." However, these height dimensions are open to experimentation to optimize any particular implementation of the invention.

The positioning of the nodal enhancers 127 is critical to the introduction of desirable harmonics of a tone being produced. As will be recognized by a person skilled in the art, the exact location will be dependent on the specific implementation. The nodal enhancers 127 work in conjunction with specific rim, cup, throat, and backbore specifications. That is, the size and position of the nodal enhancers 127 used in a trumpet mouthpiece having known in the art 3C-specification components will be different from the size and position for a trumpet having common 10C-specification components. Obviously, trumpet mouthpiece placement and size of the nodal enhancers 127 will be different from those selected for a tuba mouthpiece. By being selective in position and size of the nodal enhancers 127, introduction of desirable harmonics is accomplished. Experimentation can be made using anechoic chambers and spectrographs to optimize the location and size of the nodal enhancers 127 technically. Experimentation has shown an increase in upper frequency harmonics produced with the present invention by as much as fifty percent. However, it is well to note that technical experiment results do not always match with the subjective nature of musical tones. Trial and error with players and listeners sometimes proves that positioning and sizing other than that shown by spectral analysis machines to be optimal produces better sounds and playing characteristics. Musicians have an nearly unlimited variety of embouchures, teeth structures, and jaw and oral cavity sizes. Two musicians playing the same instrument with the same mouthpiece may produce two noticeably different sounds.

Mouthpieces built to perform in accordance with the present invention are, to keep to the music idiom, "tunable," or customizable. The nodal enhancer 127 measurements can be tailored not only to different instruments but to playing characteristics subjectively determined by players. In other words, while a spectrometer may show optimum technical performance from a particular design, users may find that an alteration to fit them personally produces more pleasing musical results.

Figure 3A:
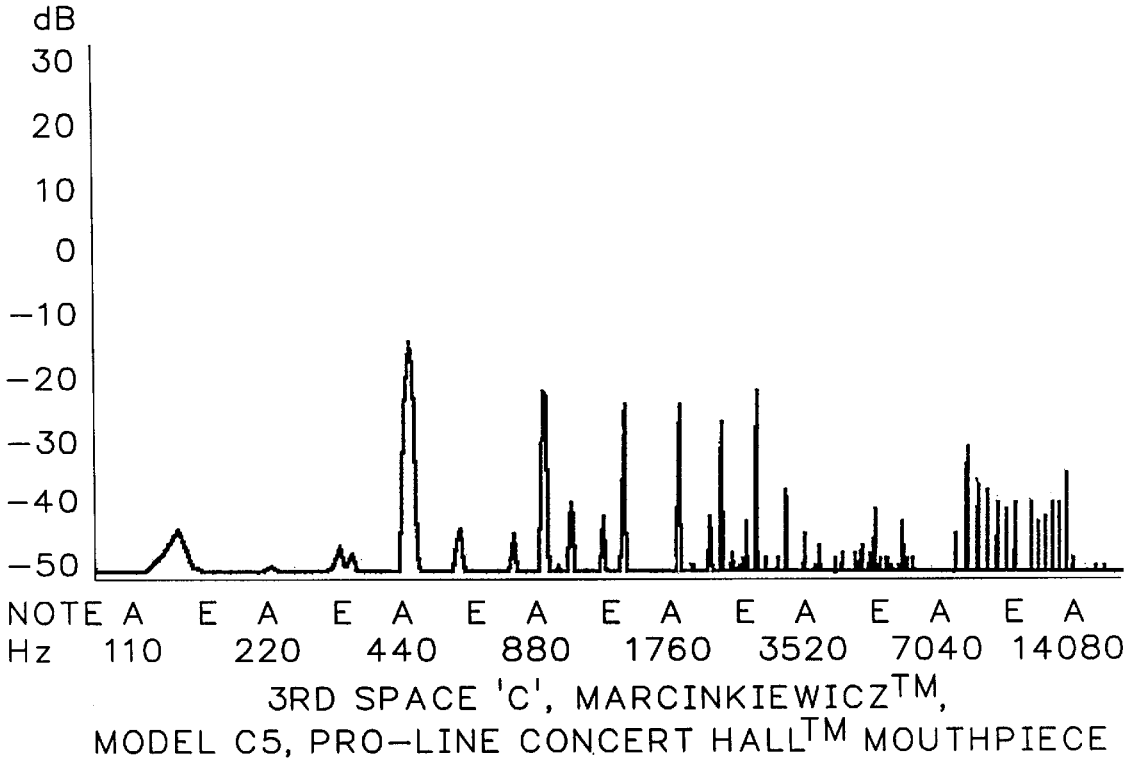
FIG. 3A–3C are graphs showing a performance comparison of the present invention as shown in FIG. 1 to other popular, commercially available, brands.
Figure 3B:
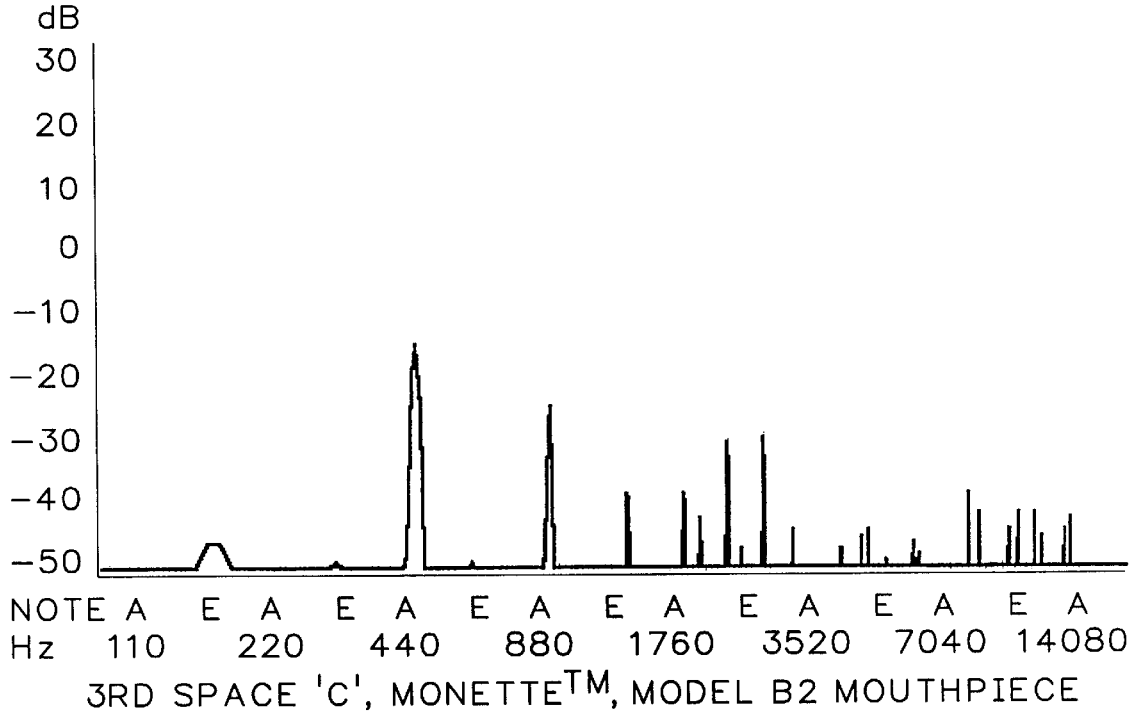
Figure 3C:
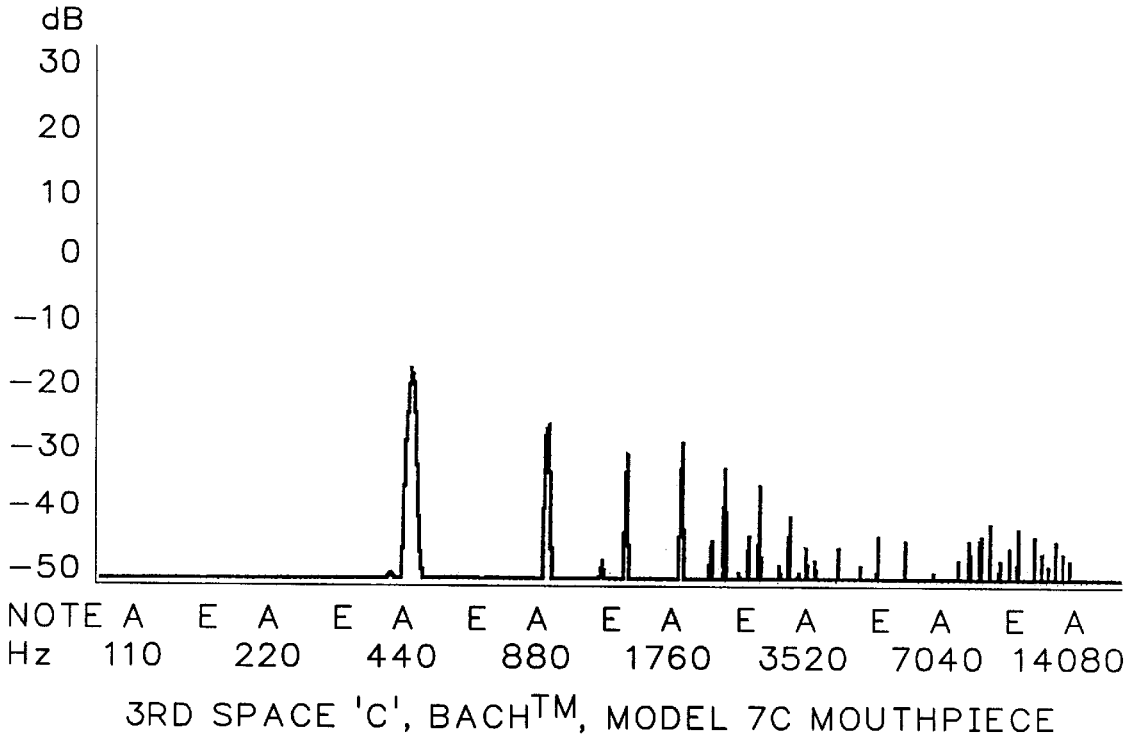

There is a definable increase in the harmonics of a musical note frequency produced by the present invention. Turning to FIGS. 3A–3C, using a single source producing tones on the same trumpet, a spectrograph was used to determine harmonic content. FIG. 3A depicts a tone—specifically the trumpet or cornet note C on the third space of a treble clef music staff; a note commonly used for tuning ("concert Bb")—and its harmonics produced with a mouthpiece manufactured in accordance with the specifications of the present invention, Marcinkiewicz™ Pro-Line Concert Hall™ model C5 mouthpiece. FIG. 3B depicts the same tone and its harmonics produced by the same source with a Monette™ model B2, heavy wall, mouthpiece, one of the most expensive trumpet mouthpieces commercially available. FIG. 3C depicts the same tone and its harmonics produced by the same source with a Bach™ model 7C mouthpiece, perhaps the most popular trumpet mouthpiece. A comparison shows the marked improvement in harmonic nodal content.

Another prominent advantage of a mouthpiece in accordance with the present invention is its ability to maintain a true intonation across the entire range of the instrument ["intonation" meaning the production of tones that are true to the vibrational standard, rather than rising (going "sharp") or falling (going "flat"); in other words, staying "in tune"]. For example, it is known that in playing a trumpet or cornet, as one gets to a high-A (one ledger line above the treble clef staff), notes begin to go flat. It is believed that this is because a combination of a player's limited ability to reach the higher end of the instrument's range along with the inability of mouthpiece designs in the current state of the art to maintain proper air compression in the cup and on downstream. The spectrographic studies also show that intonation only varies approximately ±2% from true with the Marcinkiewicz™ Pro-Line Concert Hall™ mouthpiece versus +20%/−25% for the Monettetm mouthpiece and +12%/−6% for the Bach™ mouthpiece. Thus, while referring to elements of the present invention as nodal enhancers, referring to that aspect as exemplified in FIG. 3A, a synergistic effect is apparent and improves quality of sound because of the overall construction differences of the present invention from the prior art. Looking specifically to FIG. 2, in the preferred embodiment of the mouthpiece 101, the nodal enhancers 127 have been integrated into the barrel 111 wall 201 itself. The grooves 131 are formed into the barrel wall 201 such that specific lower outer diameters a–g are created. Note that the change in outer diameter from groove to groove is neither uniform in dimensional nor sequentially progressive; that is, in the exemplary embodiment for a Bb trumpet: a>b by approximately 0.050-inch, b>c by 0.040 inch, c>d by 0.060-inch, d<e by 0.030-inch, e>f by 0.060-inch but <c by 0.030-inch, and f>g by 0.60-inch. Thus, there is not a linear, concentric, decreasing of the grooves from the rim 103 to the shank 115. Specific depth measurements are, of course, also relative to the type of brass-wind instrument mouthpiece being fabricated; i.e., tuba mouthpieces have much larger proportional overall dimensions than a cornet mouthpiece. The important factor is that the profile is not necessarily linear. An exemplary non-linear profile of the nodal enhancers is seen in FIG. 2 where it will be recognized that two barrel wall regions 201', 201" are formed having a first taper cross-section and a second taper cross-section, respectively. In other words, the barrel wall 201 starts out thickest subjacent the rim, tapers to a narrower radial measurement, then expands to a thickness less than the thickest region but greater than the narrower region and begins the second taper, or bevel, of the barrel's wall 201 thickness. Note that this add's mass below the cup's deepest extremity. Thus, in a very shallow cup, it may be advantageous to have diameter c<d rather than d<e. In the main, the barrel wall has a non-linear varying thickness.

Thus, both varying barrel wall thicknesses and the use of the nodal enhancers are within the scope of the present invention.

In the preferred embodiment for a Bb trumpet, the grooves have an inner wall 133 which is not perpendicular to the plane of adjacent ring 129 ceiling 135 and floor 137. In the best mode, the angle, $\alpha$, is approximately 15°±10° with respect to the longitudinal axis, L—L, FIG. 2, of the mouthpiece. Experimentation for a specific implementation may show other desirable angles or even a perpendicular inner wall 133 is preferred. Such modifications can also be introduced for trumpets in different keys, e.g., a C-trumpet or an Eb-trumpet.

Figure 4:
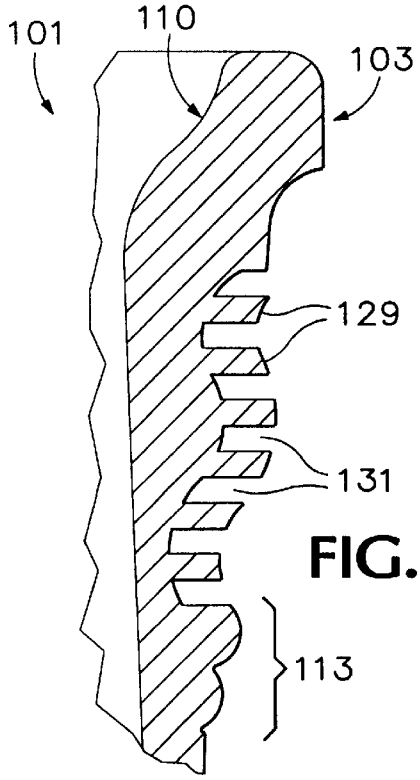
FIG. 4 is a cut-away view of an alternate embodiment of the present invention as shown in FIGS. 1 and 2.

Cutting the grooves into the cup barrel 111 a variety of depths, thereby forming rings 129 having a variety of radial length, $R_R$, is a means of tailoring a variety of nodal enhancer designs dependent upon the performance goals and the player's needs. One alternative is shown in FIG. 4.

In the exemplary preferred embodiment of FIGS. 1 and 2, the rings 129 have a uniform thickness, "H," and an outer wall 139 which is slightly curved, following a natural curve that would taper the barrel 111 from the rim 103 region to the transition region 113. These features can also be experimented with for specific implementations of the present invention. In other words, in an alternative embodiment the ring thicknesses may vary.

It has been found that the nodal enhancers 127 have several desirable affects: optimal nodal enhancement and enhanced production of a wide range of dynamic levels without distortion—an even timbre—across the entire register range of the instrument. A practical effect of this nodal enhancement is that the harmonics produced in playing a note will blend with the notes of surrounding instruments of the band and enrich the total ambient sound. The net result of the present invention is a mouthpiece that give an extremely stable center of pitch, allows great dynamic levels without distortion, and provides a preferred amount of high and low harmonics to create a natural tone and a richer overall musical sound. The present invention provides a mouthpiece that is easier to play with better intonation.

Screw on rim mouthpieces are known in the art. In an alternative embodiment, of the present invention, the rim can be unscrewed. The barrel 111 is cylindrical and treaded—possibly with sections having different diameters—such that compatibly threaded rings of different shapes and dimensions can be exchanged.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A brass-wind musical instrument mouthpiece, having a longitudinal axis and sequentially located along said axis, a rim, a barrel having an internal cup, the cup having a throat at a lowest, central, inner extremity thereof, a shank having a backbore coupled to the throat, and a transition region coupling the barrel to the shank, comprising:

the barrel coupling the rim and the transition region and encompassing the cup and throat by forming an exterior wall of the mouthpiece between the rim and the transition region, the exterior wall having a series of annular alternating rings and grooves forming nodal enhancers such that said nodal enhancers increase number and structure of harmonics produced by using the mouthpiece and, in succession from said rim to said transition region, the grooves having non-linearly varying depth dimensions into the exterior wall.

2. The mouthpiece as set forth in claim 1, said rings further comprising:

a plurality of six rings radially extending from said longitudinal axis.

3. The mouthpiece as set forth in claim 2, said grooves further comprising:

a plurality of seven grooves respectively separating the six rings.

4. The mouthpiece as set forth in claim 1, further comprising:

having said exterior wall forming a substantially cylindrical wall approximating a conical taper from said rim to said transition region radially disposed to the longitudinal axis of the mouthpiece such that the exterior wall alternatingly decreases and increases the barrel circumference from below the rim to the transition region thereby forming the rings and grooves into said nodal enhancers.

5. The mouthpiece as set forth in claim 4, further comprising:

the conical taper having a radial curve line with respect to said longitudinal axis from the rim to the transition region.

6. The mouthpiece as set forth in claim 1, further comprising:

each of the grooves having an inner wall forming the exterior wall between adjacent rings such that the groove inner wall forms an acute angle with respect to the longitudinal axis.

7. The mouthpiece as set forth in claim 6, further comprising:

the angle is approximately 15°±10°.

8. The mouthpiece as set forth in claim 1, further comprising:

the rings and grooves have respective shapes and dimensions varied to produce a preferred set of tonal harmonics.

9. A method of enhancing musical tones produced via a brass-wind musical instrument mouthpiece, the mouthpiece having an integrated rim, cup, shank, barrel region forming an external wall between a lower extremity of the rim and a transition region coupled to an upper extremity of the shank, the method comprising the step of:

varying the external wall thickness of the barrel region non-linearly to form a series of circumferential, alternating rings and grooves in calculated regions such that nodal enhancement of said musical tones is produced by said mouthpiece.

10. The method as set forth in claim 9, the step of varying the external wall thickness of the barrel region comprising the step of:

providing external nodal enhancers, said enhancers including alternating the grooves and rings in the wall of the external wall circumferentially about the cup and extending in a series down to the transition region wherein the rings and grooves have a non-linearly varying radius from a longitudinal center axis of said mouthpiece.

11. A brass-wind musical instrument mouthpiece, having a longitudinal axis, the mouthpiece comprising:

sequentially positioned along said longitudinal axis, a rim for interfacing the mouthpiece to a player's lips, an interior cup beginning at the rim and continuing into the mouthpiece, a barrel, having an outer wall surrounding the cup, an exterior transition region wall, and a shank, having a backbore therethrough, wherein the backbore is in open communication with a lowest extremity of the cup through a venturi, wherein said barrel has a series of nodal enhancers, including said outer wall having non-linearly varying, diametric thicknesses circumferentially located with respect to said axis between said rim and said transition region wall such that said nodal enhancers increase number and structure of harmonics produced by using the mouthpiece.

12. The mouthpiece as set forth in claim 11, further comprising:

the barrel outer wall having an exterior taper beginning at a widest diameter at the rim and a narrowest diameter at the transition region wall and forming intermediate barrel wall thicknesses varying between said widest diameter and said narrowest diameter in predetermined positions for producing nodal enhancement of tones generated with the mouthpiece.

13. The mouthpiece as set forth in claim 12, further comprising:

the barrel outer wall bearing a plurality of said nodal enhancers.

14. The mouthpiece as set forth in claim 13, the nodal enhancers further comprising:

six longitudinally-spaced rings extending from the barrel in a substantially radial configuration with respect to the longitudinal axis of the mouthpiece.

15. The mouthpiece as setforth in claim 14, the nodal enhancers further comprising:

a plurality of grooves cut into the barrel outer wall substantially perpendicularly to the longitudinal axis of the mouthpiece, separating each of the rings.

16. The mouthpiece as set forth in claim 15, further comprising:

the mouthpiece is a unitary part with the rings and grooves formed integrally thereto.

17. The mouthpiece as set forth in claim 15, further comprising:

the grooves are cut into the barrel outer wall a variety of distances, forming the rings such that a profile of the nodal enhancers parallel to said axis is non-linearly stepped.

18. The mouthpiece as set forth in claim 17, further comprising:

each of the grooves having an inner wall between adjacent rings such that the groove inner wall forms an angle with respect to the longitudinal axis of the mouthpiece.

19. The mouthpiece as set forth in claim 17, further comprising:

the rings and grooves have a predetermined shapes and sizes to tune the mouthpiece such that a predetermined preferred set of tonal harmonics is produced.

* * * * *